United States Patent [19]

Patel et al.

[11] Patent Number: 4,922,594

[45] Date of Patent: May 8, 1990

[54] METHOD OF MAKING A FOCUSSING ELEMENT FOR USE IN A LENSELESS FOCUSSED TRANSDUCER

[75] Inventors: Narenora Patel, Hamilton; Jan Van den Andel, Burlington; Patrick S. Nicholson, Ancaster; Alicja H. Grzymer, Hamilton, all of Canada

[73] Assignee: Her Majesty the Queen as represented by the Minister of National Defence of Her Majesty's Canadian Government, Ottawa, Canada

[21] Appl. No.: 179,266

[22] Filed: Apr. 8, 1988

[51] Int. Cl.[5] ..... H04R 17/00

[52] U.S. Cl. ..... 29/25.35; 181/175; 181/176

[58] Field of Search ..... 29/25.35; 181/144, 148, 181/152, 155, 175, 176; 381/173, 188, 190, 191, 203

[56] References Cited

U.S. PATENT DOCUMENTS

| | | | |
|---|---|---|---|
| 2,405,604 | 8/1946 | Pope | 381/173 |
| 4,009,516 | 3/1977 | Chiang et al. | 29/25.35 |
| 4,530,139 | 7/1985 | Miller | 29/25.35 |

FOREIGN PATENT DOCUMENTS

| | | | |
|---|---|---|---|
| 44313 | 3/1982 | Japan | 29/25.35 |
| 3394 | 1/1983 | Japan | 29/25.35 |
| 33393 | 1/1983 | Japan | 29/25.35 |

*Primary Examiner*—P. W. Echols

*Attorney, Agent, or Firm*—Nixon & Vanderhye

[57] ABSTRACT

A focussing element for use in a lenseless, focussed transducer for producing a semi-focussed, ultrasonic beam comprises a body formed of electrical insulating material and a plurality of piezoelectric elements disposed in one end of the body, each element being planar, extending outwardly from a common axis, and being disposed at a predetermined angel to the common axis whereby to define a common focal point on the axis, and electrical conductors secured to the piezoelectric element for electrically exciting the elements.

2 Claims, 4 Drawing Sheets

METHOD OF MAKING A FOCUSSING ELEMENT FOR USE IN A LENSELESS FOCUSSED TRANSDUCER

This invention relates to an ultrasonic transducer for use in the ultrasonic inspection of high performance ceramics and, more specifically, to a focussing element for use in an ultrasonic transducer producing a semifocussed ultrasonic beam without using a lens.

BACKGROUND OF THE INVENTION

Ultrasonic inspection of high performance ceramics requires higher frequencies and higher power than hitherto used for the inspection of metallic components. Focussing of ultrasonic beams at lower frequencies is accomplished by positioning an acoustical lens positioned in front of the transducer. The higher frequencies required when inspecting high performance ceramics are absorbed by the lens material resulting in a noticeable reduction of signal strength.

SUMMARY OF THE INVENTION

The present invention seeks to provide an ultrasonic transducer which produces a semi-focussed beam without a lens and, therefore, which is not subject to the limitations and drawbacks of conventional transducers. The present invention also seeks to provide a method of making a focussing element for a lenseless ultrasonic transducer.

Thus, in accordance with one aspect of the present invention, there is provided a focussing element for use in a lenseless, focussed transducer for producing a semi-focussed, ultrasonic beam, the element comprising body means formed of electrical insulating material; a plurality of piezoelectric elements disposed in one end of the body means, each of the elements being planar, extending radially outwardly from a common axis and being disposed at a predetermined angle to the axis whereby to define a common focal point on the axis; and electrical conductor means secured to each of the elements for electrically exciting the elements.

In accordance with another aspect of the present invention, there is provided a method of making a focussing element for use in a lenseless, focussed transducer for producing a semi-focussed, ultrasonic beam, the method comprising the steps of:

(a) cutting a polarized piezoelectric disk into a plurality of substantially identical sectors having first and second opposed surfaces;
(b) simultaneously lapping the sectors to a predetermined thickness on a lapping plate;
(c) while still on the lapping plate,
  i. electroding the first surface of each sector with gold;
  ii. securing a fine copper wire to the first surface of each sector with silver epoxy resin;
  iii. applying a tungsten-epoxy mixture to the first surface of each of the sectors;
  iv. cutting the mixture along the side edges of the sectors so as to form a plurality of backed piezoelectric petals;
(d) bonding with wax the first surface of each of the petals onto a pyramidal surface of a pyramid faceted rod end;
(e) electrically connecting the free ends of the wires;
(f) applying additional tungsten-epoxy mixture to the first surfaces of the petals so as to form an epoxy body while embedding a portion of the wires in the additional mixture with the free end of the connected wires emerging from the end of the body remote from the petals;
(g) circumferentially dressing the body; and
(h) supporting a ¼-wavelength hydrophobic layer onto the second surface of each petal.

BRIEF DESCRIPTION OF THE DRAWINGS

These and other features of the invention will become more apparent from the following description in which reference is made to the appended drawings wherein.

DETAILED DESCRIPTION OF PREFERRED EMBODIMENT

Figure 9:
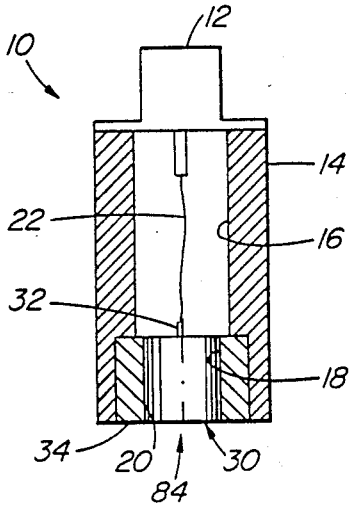
FIG. 9 is a diagrammatic, cross-sectional view of the focussing element of the present invention positioned in an ultrasonic transducer housing.

With reference to FIG. 9 of the drawings, there is illustrated an ultrasonic transducer 10 having a conventional BNC connector 12 secured to one end of a tubular stainless steel housing 14. The housing is formed with a bore 16 whose end remote from connector 12 is formed with an enlarged bore 18 for receiving a tubular stainless steel sleeve 20 which, in turn, receives a focussing element 30 according to the present invention. Wires 32 extending from the back of element 30 are connected to the center conductor of a coaxial cable 22 extending from the connector, as shown. The front edge 34 of the element and the ground electrode are electrically connected to housing 14.

Figure 1:
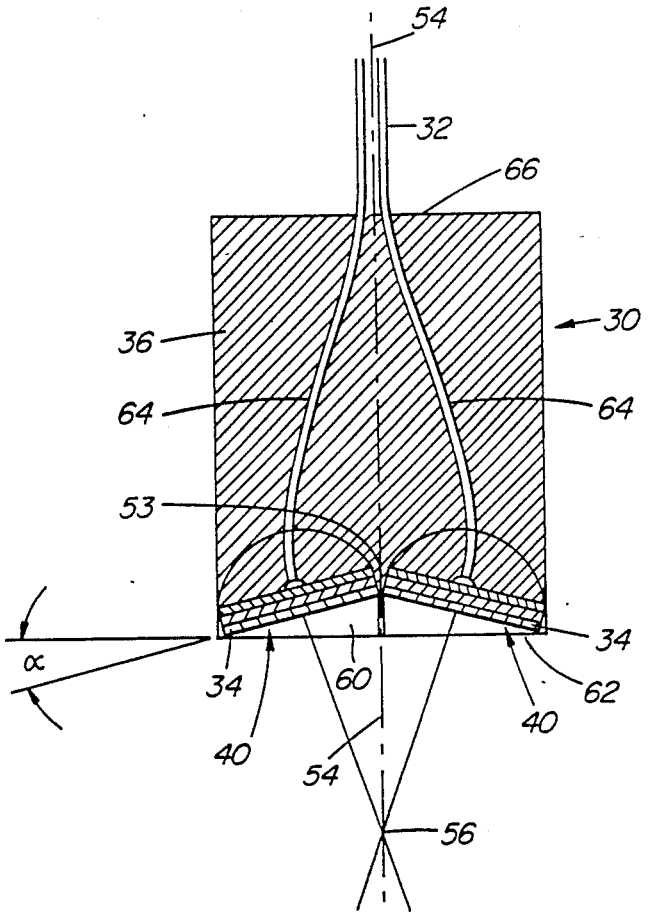
FIG. 1 is a longitudinal cross-sectional view taken through the preferred embodiment of the focussing element of the present invention.

FIG. 1 of the drawings is a longitudinal cross-sectional view of focussing element 30. The element is comprised of a body means 36 formed of electrical insulating material, such as tungsten-epoxy resin, and a plurality of piezoelectric elements 40 disposed in one end of body 36. In the illustrated embodiment, four piezoelectric elements or quadrants are provided; however, it will be understood that a larger or smaller number may be provided without departing from the spirit of the invention.

Figure 2:
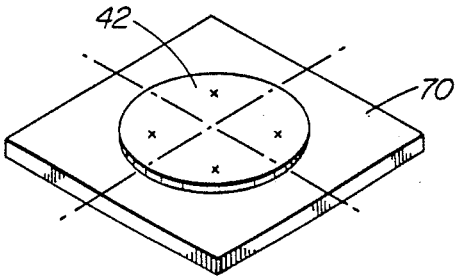
FIG. 2 is a diagrammatic, perspective view illustrating a polarized piezoelectric disk on a microscopic slide prior to cutting.

Each piezoelectric element is in the form of a planar sector cut from a polarized piezoelectric disk 42 (FIG. 2), as explained more fully below, and includes an apex 44, divergent side edges 46 and an arcuate edge 48 (see FIG. 3). Each element further includes a positive face 50 and a negative face 52.

Piezoelectric elements 40 are spaced from one another by electrical insulating material 53, integral with body 36, and extend outwardly from a common axis, namely, the longitudinal axis 54 of the body. Further, the elements are disposed at a predetermined angle in the range of 50° to 87° with respect to axis 54 whereby to define a common focal point 56 on the axis, as shown. The angle employed would be pre-selected to provide the desired focal length and focal diameter. When so arranged, the piezoelectric elements define a pyramidal depression or recess 60 in the front end 62 of the body.

Negative face 52 of the elements face axially outwardly of the body while positive face 50 faces inwardly. Face 50 of each element is electroded with gold and connected to one end of a fine copper wire 64 which is embedded in the body and emerges from the back end 66 thereof. The exterior ends of all of the wires are connected together and form aforementioned wires 32 which are connected to the center conductor of coaxial cable 22, as mentioned earlier. The front 62 of the transducer housing is gold electroded and then a ¼-wavelength layer of hydrophobic material is sprayed onto the front of the electroded, negative electrode.

The method of making focussing element 30 will now be described with reference to FIGS. 2–8.

The negative face of a polarized piezoelectric disk 42, having a diameter in the range of 1 to 1.2 cm and a thickness in the range of 0.2 to 0.5 cm, is placed on and bonded to a microscopic slide 70 with crystalbond wax. Using a thick diamond blade, two diametrical cuts are made in the disk to provide four identical quadrants. The resulting petals are removed from the slide by warming the slide to about 120° C. and are cleaned in acetone in an ultrasonic transducer.

Figure 3:
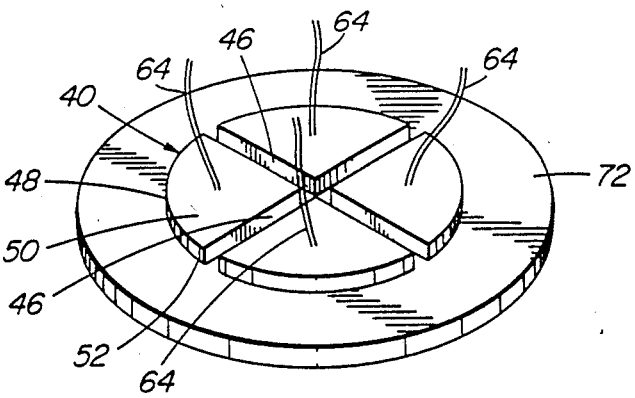
FIG. 3 is a diagrammatic perspective view of the polarized piezoelectric disk positioned on a quartz plate after cutting showing four quadrants and attached electrical conductors.

As shown in FIG. 3, the petals are arranged, negative side down, in spaced apart relation in the form of a disk on an optically-flat and parallel quartz plate 72. The plate may have a diameter of about 6 cm and a thickness of about 4 mm. When properly arranged, the petals are bonded to the plate using crystalbond wax. The quartz plate is then vacuum bonded to the face of a precision lapping jig (not shown) and the petals are simultaneously ground to a thickness in the range of 30–100 μm. A 600 grit silicon-carbide slurry (silicon carbide mixed with water) is fed to the grinding plate.

Figure 4:
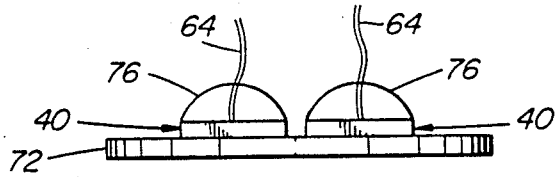
FIG. 4 is an end view of the quartz plate and two quadrants thereon with tungsten-epoxy applied to the negative face of the quadrants.
Figure 7:
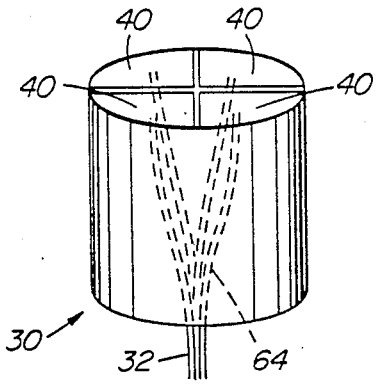
FIG. 7 is a perspective view of a focussing element according to a preferred embodiment of the present invention.
Figure 8:
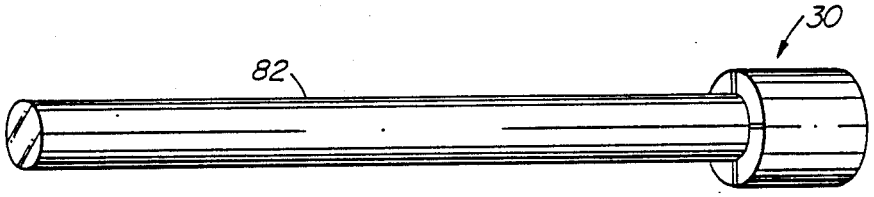
FIG. 8 is a perspective view of the focussing element secured to the end of a steel rod prior to circumferential dressing.

Upon completion of the grinding process, the quartz plate with the four petals attached thereto is cleaned in water using an ultrasonic cleaner and the cleaned plate is placed in a gold sputtering unit (not shown) so that the positive face of the four petals is electroded with gold to a thickness of about 4000 Å. The wax between and around the four petals is thereafter removed so as to electrically isolate the four petals from one another. One end of a fine copper wire 64 is then attached to the gold electroded positive face of each petal using silver epoxy such as +120E EPOTECH (trade mark). The silver epoxy is cured in air at about 70° C. for 3 or more hours. Once the solder has cured, 2–4 mm of a tungsten epoxy mixture 76 is carefully placed on the back (gold electroded, positive face) of each of the petals as shown in FIG. 4. This mixture absorbs sound waves and, thus, serves as a damping medium.

Figure 5A:
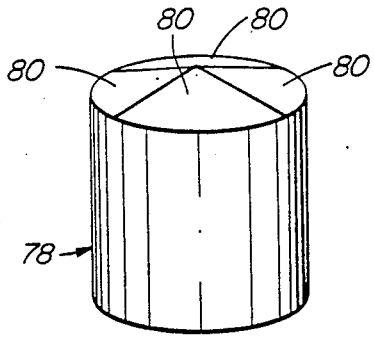
FIG. 5*a* is a perspective view of a rod formed with pyramid facets on one end thereof for use in assembling the focussing device of the present invention.
Figure 5B:
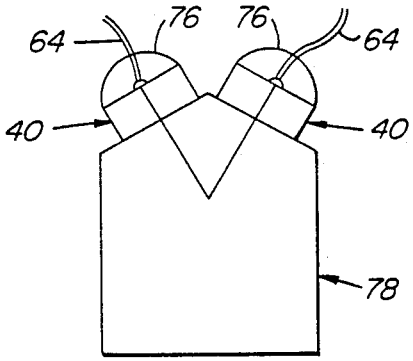
FIG. 5*b* is an elevational view illustrating a pair of quadrants positioned on the pyramid surfaces of the rod illustrated in FIG. 5*a;*
Figure 6A:
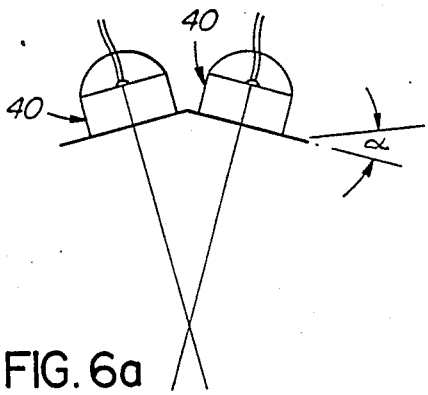
FIGS. 6*a* and 6*b* are diagrammatic views illustrating the quadrants at different angular positions.
Figure 6B:
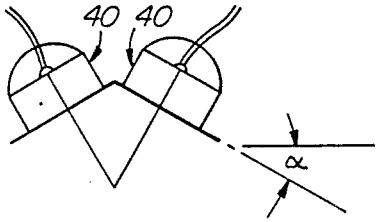

FIG. 5*a* illustrates a steel rod 78 having a regular pyramidal shape ground on one end thereof for use in assembling the piezoelectric elements into their final positions. The angle of pyramid surfaces 80 determines the focal length of the resulting focussing element and, accordingly, different rods are required for different focussing elements. The rod is warmed before each petal is carefully positioned on one of pyramid surfaces 80 as shown in FIG. 5*b*. After the assembly has been allowed to cool, the four petals are bonded together using tungsten epoxy. The back is built-up further with epoxy to form body 36. The copper wires are carefully embedded in the mixture during this process. The free ends of the wires are subsequently soldered together.

Following the soldering step, the assembly is removed from rod 78 by warming the rod and the crystalbond wax is cleaned off completely using acetone. Any spaces between the petals from the front of the assembly are filled with epoxy. Care should be taken to ensure that the epoxy does not overflow onto the front surface of the petals.

The assembly is then coaxially secured to a second steel rod 82 with crystalbond wax and circumferentially dressed to the desired final diameter, which may be in the order of 6–10 mm, with SIC paper. Finally, by warming the rod, the assembly is removed from the rod and it is then cleaned with acetone.

The assembly is drawn into the bore of sleeve 20 and positioned as shown in FIG. 9. The front 84 of the transducer housing is gold-electroded and then a layer of hydrophobic material having a thickness of one-fourth of the beam's wavelength is sprayed onto the front of the electroded, negative electrode. The hydrophobic layer ensures that maximum energy is transferred into the couplant medium (water) which is used in ultrasonic tests. It also ensures that water does not penetrate the transducer.

The embodiments of the invention in which an exclusive property or privilege is claimed are defined as follows:

1. A method of making a focusing element for use in a lenseless, focussed transducer for producing an ultrasonic beam, said method comprising the steps of:

(a) cutting a polarized piezoelectric disk into a plurality of substantially identical sectors having first and second opposed surfaces;

(b) simultaneously lapping said sectors to a predetermined thickness on a lapping plate;

(c) while still on said lapping plate, i. electroding said first surface of each said sector with gold;

ii. securing a fine copper wire to said first surface of each said sectors with silver epoxy resin;

iii. applying a tungsten-epoxy mixture to said first surface of each said sectors; and iv. cutting said mixture along the side edges of said sectors so as to form a plurality of backed piezoelectric petals;

(d) removing said sectors from said lapping plate and bonding with wax said second surface of each said petals onto a pyramidal surface of a pyramid facetted rod end;

(e) electrically connecting the free ends of said wires;

(f) applying additional tungsten-epoxy mixture to said first surfaces of said petals so as to form an epoxy body while embedding a portion of said wires in said additional mixture with the free end of connected wires emerging from the end of said body remote from said petals;

(g) circumferentially dressing said body; and (h) removing said body from said rod and sputtering a hydrophobic layer onto said second surface of each said petal, said hydrophobic layer having a thickness of ¼ of the wavelength of said beam.

2. A method of making a focussing element for use in a lenseless, focussed transducer for producing an ultrasonic beam, said method comprising the steps of:

(a) forming a piezoelectric disc of predetermined diameter and thickness, said disk having a positive face and a negative face;

(b) bonding said negative face of said disk to a microscopic slide with crystalbond wax;

(c) cutting said disk into four equal quadrants using a thick diamond blade;

(d) removing said quadrants from said slide by warming said slide to a predetermined temperature and cleaning said quadrants with acetone;

(e) arranging, negative side down, said quadrants in spaced apart relation in the form of a disk onto an optically-flat parallel quartz plate and bonding said quadrants to said plate using crystalbond wax;

(f) vacuum bonding said plate to the face of a precision lapping jig;

(g) simultaneously grinding said positive face of said quadrants to a predetermined thickness using a 600 grit silicon-carbon slurry in said lapping jig;

(h) while still on said plate, i. cleaning said quadrants in water using an ultrasonic cleaner;

ii. electroding said positive face of each said sector with gold to a thickness of approximately 4000 Å;

iii. removing the wax from the spaces between the quadrants so as to electrically isolate said quadrants;

iv. securing a fine copper wire to said positive face of each said quadrants with silver epoxy resin and allowing said resin to dry in air for three or more hours;

v. applying 2–4 mm of a tungsten-epoxy mixture to said positive face of each said quadrants to provide an acoustical damping medium; and vi. cutting said mixture along the side edges of said quadrants so as to form four, spaced, backed piezoelectric petals;

(i) warming a steel rod having pyramid facets formed on one end thereof and positioning and bonding with crystalbond wax each of said petals onto one of the pyramid surfaces of said rod;

(j) allowing said rod to cool and bonding said petals together with an additional tungsten-epoxy mixture so as to form an epoxy body while embedding a portion of said wires in said additional mixture with the free end of connected wires emerging from the end of said body remote from said petals;

(k) soldering the free ends of said wires;

(l) coaxially securing said body to a steel rod with crystalbond wax and circumferentially dressing said body to a predetermined diameter with SIC paper;

(m) removing said body from said rod by warming said wax and cleaning said body with acetone; and (n) spraying a hydrophobic layer onto said negative face of each said petal, said hydrophobic layer having a thickness of ¼ of the wavelength of said beam.

* * * * *